US009608311B2

(12) United States Patent
Qiu

(10) Patent No.: US 9,608,311 B2
(45) Date of Patent: Mar. 28, 2017

(54) ANTENNA AND TERMINAL DEVICE

(71) Applicant: ZTE CORPORATION, Shenzhen, Guangdong (CN)

(72) Inventor: Zhi Qiu, Shenzhen (CN)

(73) Assignee: ZTE Corporation, Guangdong (CN)

( * ) Notice: Subject to any disclaimer, the term of this patent is extended or adjusted under 35 U.S.C. 154(b) by 72 days.

(21) Appl. No.: 14/413,467

(22) PCT Filed: Jun. 26, 2013

(86) PCT No.: PCT/CN2013/078046
§ 371 (c)(1),
(2) Date: Jan. 8, 2015

(87) PCT Pub. No.: WO2013/185654
PCT Pub. Date: Dec. 19, 2013

(65) Prior Publication Data

US 2015/0123856 A1 May 7, 2015

(30) Foreign Application Priority Data

Jul. 11, 2012 (CN) ..... 2012 1 0239042

(51) Int. Cl.
*H01Q 1/38* (2006.01)
*H01Q 1/24* (2006.01)
(Continued)

(52) U.S. Cl.
CPC ..... *H01Q 1/243* (2013.01); *H01Q 1/36* (2013.01); *H01Q 5/371* (2015.01);
(Continued)

(58) Field of Classification Search
CPC ..... H01Q 1/243; H01Q 1/38; H01Q 19/005
(Continued)

(56) References Cited

U.S. PATENT DOCUMENTS 7,446,713 B2 11/2008 Kim
2003/0052824 A1 3/2003 Ollikainen et al.
(Continued)

FOREIGN PATENT DOCUMENTS

CN 2788380 6/2006
CN 101950856 1/2011
(Continued)

OTHER PUBLICATIONS

Japanese Office Action for Japanese Application No. 2015-520806, English Machine translation attached to original, Dated Jan. 26, 2016, All together 7 Pages.
(Continued)

*Primary Examiner* — Dieu H Duong
(74) *Attorney, Agent, or Firm* — Brooks Kushman P.C.

(57) ABSTRACT

An antenna and a terminal device include a Printed Circuit Board (PCB), a first main antenna, a second main antenna and a connection component. The first main antenna is printed on the PCB, and the second main antenna is configured outside the PCB and electrically connected to the first main antenna through the connection component. By connecting the antenna printed on the PCB with the antenna configured outside the PCB, the limitation that wiring space is not enough in the existing antenna design is made up, and the utilization of the limited space can be significantly improved when the wiring of the antenna is designed.

10 Claims, 1 Drawing Sheet

(51) Int. Cl.

| | |
|---|---|
| ***H01Q 9/04*** | (2006.01) |
| ***H01Q 9/42*** | (2006.01) |
| ***H01Q 1/36*** | (2006.01) |
| ***H01Q 5/371*** | (2015.01) |
| ***H01Q 21/00*** | (2006.01) |
| ***H01Q 21/30*** | (2006.01) |

(52) U.S. Cl.
CPC ..... *H01Q 9/0414* (2013.01); *H01Q 9/42* (2013.01); *H01Q 21/0006* (2013.01); *H01Q 21/30* (2013.01)

(58) Field of Classification Search
USPC ..... 343/702, 700 MS
See application file for complete search history.

(56) References Cited

U.S. PATENT DOCUMENTS

| | | | | |
|---|---|---|---|---|
| 2006/0145933 | A1 | 7/2006 | Kim | |
| 2007/0229376 | A1 | 10/2007 | Desclos et al. | |
| 2009/0002244 | A1 | 1/2009 | Woo | |
| 2009/0184874 | A1* | 7/2009 | Chi ..... | H01Q 1/243 343/700 MS |
| 2012/0169568 | A1 | 7/2012 | Oh et al. | |

FOREIGN PATENT DOCUMENTS

| | | |
|---|---|---|
| CN | 201845856 | 5/2011 |
| CN | 201985248 | 9/2011 |
| EP | 2020698 | 2/2009 |
| JP | 2005094501 | 4/2005 |
| JP | 2006191561 | 7/2006 |
| JP | 2011211491 | 10/2011 |
| KR | 20080114226 | 12/2008 |
| WO | 2010125240 | 11/2010 |

OTHER PUBLICATIONS

International Search Report for PCT/CN2013/078046, English translation attached to original, Both completed by the Chinese Patent Office on Jul. 30, 2013, All together 5 Pages.

European Patent Office, Examination Report for the corresponding European Patent Application No. 13 803 836.9 dated Mar. 21, 2016.

Extended European Search Report for European Application No. 13803836.9, Completed by the European Patent Office, Dated May 4, 2015, 9 Pages.

Korean Office Action for Korean Application No. 10-2015-7000274, Completed by the Korean Patent Office, Dated Nov. 18, 2015, 6 Pages.

* cited by examiner

ANTENNA AND TERMINAL DEVICE

CROSS-REFERENCE TO RELATED APPLICATION

This application is the U.S. national phase of PCT Application No. PCT/CN2013/078046 filed on Jun. 26, 2013, which claims priority to Chinese Patent Application No. 201210239042.1 filed on Jul. 11, 2012, the disclosures of which are incorporated in their entirety by reference herein.

TECHNICAL FIELD

The present document relates to the technical field of antennas and terminal devices, and in particular, to an antenna and a terminal device.

BACKGROUND OF THE RELATED ART

Nowadays, with the development of communication technology and continuous expansion of requirements of user experience, a bigger screen and a thinner shape are becoming the mainstream trend in the development of appearance of mobile phones. Due to requirements on a high bandwidth, the existing mobile phone generally uses a basic antenna form of monopole antenna. However, as the realization of this form requires considerable headroom, a projection area of the screen becomes a restricted zone of the antenna design. In other words, the growing of the screen and the shrinking of the keyboard area make the design space of the antenna in the horizontal plane become continuously shrunk. Due to the pursuit of a thinner shape, the longitude design space is also restricted. How to design an antenna satisfying performance requirements by making use of the space has become a practical problem which must be faced up by the antenna design.

SUMMARY

The technical problem to be solved by the embodiments of the present invention is to provide an antenna and a terminal device, which can largely reduce the occupied wiring space in a case of satisfying the antenna performance.

In order to solve the above technical problem, the following technical scheme will be used:

An antenna comprises: a Printed Circuit Board (PCB), a first main antenna, a second main antenna and a connection component, wherein the first main antenna is printed on the PCB, and the second main antenna is configured outside the PCB, and electrically connected to the first main antenna through the connection component.

Alternatively, the second main antenna is configured on a support or a housing of a terminal device where the antenna is located.

Alternatively, the parasitic unit is printed on the PCB, is located on the same side as the first main antenna, has a gap with the first main antenna, and is connected to the ground wire; or the parasitic unit is configured on the support or the housing of the terminal device where the antenna is located, is located on the same side as the second main antenna, has a gap with the second main antenna, and is connected to the ground wire.

Alternatively, the first main antenna comprises a feed part, which is connected to an antenna feed unit on the PCB, or the second main antenna comprises a feed part, which is connected to the antenna feed unit.

Alternatively, the second main antenna comprises a main section of the second main antenna and an auxiliary section of the second main antenna which are independent from each other, the main section of the second main antenna comprises the feed part and is connected to the antenna feed unit and the first main antenna, and the auxiliary section of the second main antenna is connected to the first main antenna.

Alternatively, the first main antenna operates at a high frequency part, and the second main antenna operates at a low frequency part; or the first main antenna operates at the low frequency part and the second main antenna operates at the high frequency part.

A terminal device comprises a terminal housing, a main board and an antenna, wherein the main board and the antenna are configured in the housing, the antenna comprises a first main antenna, a second main antenna and a connection component, the first main antenna is printed on the main board, and the second antenna is configured outside the main board and is electrically connected to the first main antenna through the connection component.

Alternatively, the second main antenna is configured on a support or the housing of the terminal device where the antenna is located.

Alternatively, the terminal device further comprises a parasitic unit, wherein, the parasitic unit is printed on the PCB, is located on the same side as the first main antenna, has a gap with the first main antenna, and is connected to the ground wire; or the parasitic unit is configured on the support or the housing of the terminal device where the antenna is located, is located on the same side as the second main antenna, has a gap with the second main antenna, and is connected to the ground wire.

Alternatively, the first main antenna comprises a feed part, which is connected to an antenna feed unit on the PCB, or the second main antenna comprises a feed part, which is connected to the antenna feed unit, the second main antenna comprises a main section of the second main antenna and an auxiliary section of the second main antenna which are independent from each other, the main section of the second main antenna comprises the feed part and is connected to the antenna feed unit and the first main antenna, and the auxiliary section of the second main antenna is connected to the first main antenna.

In conclusion, in the above technical solution, by connecting the antenna printed on the PCB with the antenna configured outside the PCB, the limitation that wiring space is not enough in the antenna design is made up, and the utilization of the limited space can be significantly improved when the wiring of the antenna is designed.

PREFERRED EMBODIMENTS OF THE PRESENT INVENTION

The present embodiment proposes an innovative antenna structure, comprising a main antenna and a parasitic unit. The main antenna includes two parts, i.e., a first main antenna and a second main antenna, wherein the first main antenna is printed on the PCB, and the second main antenna is configured outside the PCB, and electrically connected to the first main antenna through a connection component. Good electrical connection is achieved between the first main antenna and the second main antenna through the connection component, and the first main antenna and the second main antenna operate as a whole.

For the first main antenna printed on the PCB, it is formed by being directly and metallically printed in headroom at one end of the PCB, and the shape thereof is not limited.

The first main antenna may be directly connected to the antenna feed unit on the PCB, or may be a number of independent metal sections which are not directly connected to the antenna feed unit on the PCB or the ground wire.

Both the first main antenna and the second main antenna may include a number of sections, and keep good electrical connection at a number of positions in a suitable way. Connection positions may be set differently as needed. The connection may be implemented in a form of using a metal elastic piece structure or a metal PIN pin, or other connection manners with similar functions. When the above function is achieved in a form of using a metal elastic piece or a metal PIN pin, connection positions of surface copper exposure must be reserved on the first main antenna and the first main antenna.

The second main antenna may be configured on a support or may be directly configured on a housing of the terminal device, and may be manufactured using metal elastic piece, FPC material, LDS processes, or other processes satisfying the above requirements.

The second main antenna configured outside the PCB may be directly connected to the antenna feed unit on the PCB, or may also independent metal parts which are not directly connected to the ground wire or the antenna feed unit.

The parasitic unit may be directly connected to the PCB in a manner of using PCB printing or may be configured on the support or the housing of the terminal device in a manner of using non-printing, and keeps in good electrical connection with the ground wire of the PCB.

In order to enable the technical features and application advantages of the present embodiment to be more clear, the present document will be further described in detail below in conjunction with accompanying drawings.

Embodiment One

Figure 1:
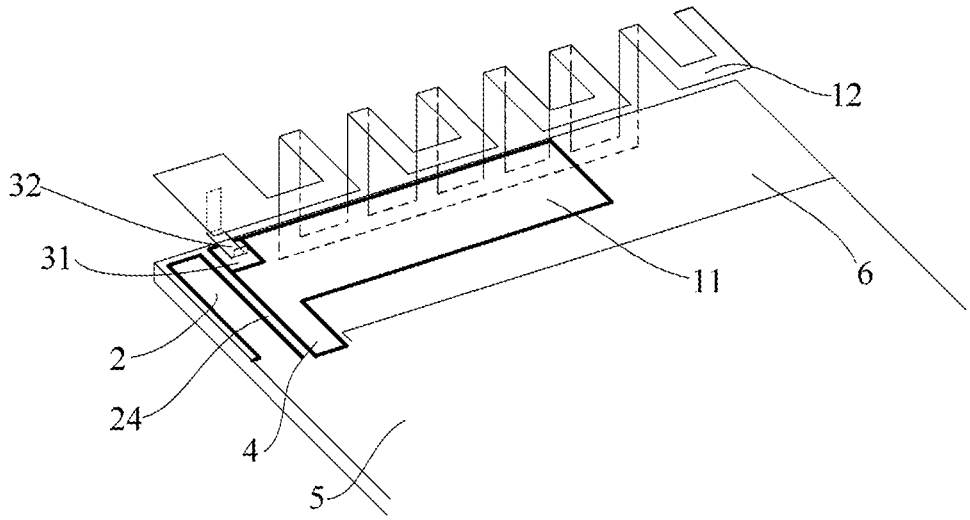
FIG. 1 is a structural diagram of an antenna according to embodiment one of the present invention.

FIG. 1 is an antenna according to the present embodiment, which includes a first main antenna 11, a second main antenna 12, a parasitic unit 2, and a connection component for keeping good electrical connection between the first main antenna 11 and the second main antenna 12. In the present embodiment, the connection component includes a copper exposure area 31 configured on the first main antenna, and a metal elastic piece 32 integrated directly with the second main antenna 12. The whole structure of the antenna is configured in the headroom 6 on the PCB 5.

The first main antenna 11 includes a feed part 4, which is directly integrated with the first main antenna 11, and is an integral area of the first main antenna 11. The first main antenna 11 keeps good electrical connection with the antenna feed unit through the feed part 4. The first main antenna 11 is a regularly shaped metal area printed in the headroom 6 of the PCB 5, and primarily operates at a high frequency part above 1700 MHz. There is a rectangular copper exposure area 31 at an upper left corner of the first main antenna 11, which achieves good electrical connection between the first main antenna 11 and the second main antenna 12 together with an metal elastic piece 32.

The second main antenna 12 is configured on a support in a fixed shape, and is of metal material. The wiring is in a form of folded serpentine. A part of the wiring of the second main antenna 12 is distributed before the support, and the other part is distributed on an upper surface of the support. The second main antenna 12 is primarily designed to operate at a low frequency part lower than 1 GHz. A metal elastic piece 32 integrated with the second main antenna 12 is configured at the left side of the second main antenna 12. This component achieves good electrical connection between the second main antenna 12 and the first main antenna 11 together with the copper exposure area 31 configured below the component and on the first main antenna 11.

The parasitic unit 2 is directly printed in the headroom 6 on the PCB 5, is directly integrated with the ground wire of the PCB 5, and has a gap 24 left with the first main antenna 11.

In the present embodiment, the electrical signal is feed by the feed part 4 in the first main antenna 11. A part of the signal is directly fed in the first main antenna 11, to form radiation operating at a high band; and the other part is fed in the second main antenna 12 via the copper exposure part 31 configured on the first main antenna 11 and the metal elastic piece 32 configured on the second main antenna 12, to form radiation operating at a low band. At the same time, the high frequency part of the first main antenna 11 is further extended by the parasitic unit 2.

The second main antenna 12 in the present embodiment may be but is not limited to a form of wiring of the metal elastic piece on the support. Alternatively, the FPC wiring may be implemented on the support, or the wiring is directly designed on the back housing or rear housing through the metal elastic piece, FPC or using an LDS process without using the support. Alternatively, any other design forms which can achieve the above purpose may be used.

The connection component in the present embodiment, i.e., the copper exposure part 31 configured on the first main antenna 11 and metal elastic piece 32 configured on the second main antenna 12 corresponding to the copper exposure part 31 may also use a metal pin or other collocation forms which can achieve the above purpose.

In the present embodiment, specific wiring forms and operating bands of the first main antenna 11 and the second main antenna 12 may be adjusted according to performance requirements and debugging needs. As long as the forms embody a combination of a PCB antenna and a non-PCB antenna, the forms belong to the protection scope.

It may be decided whether the parasitic unit 2 is added according to a change of application conditions and performance requirements.

Embodiment Two

Figure 2:
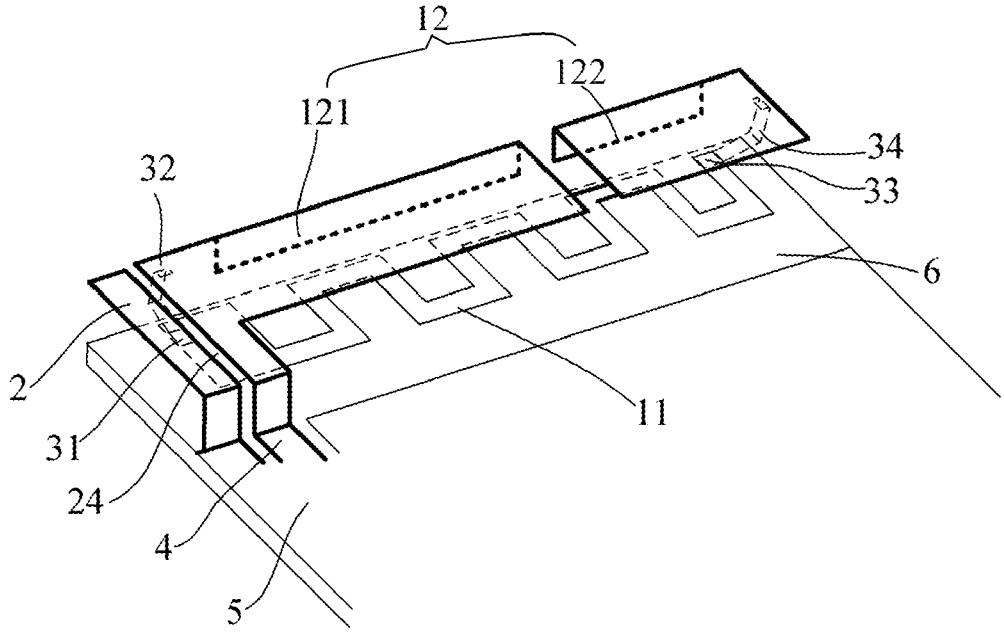
FIG. 2 is a structural diagram of an antenna according to embodiment two of the present invention.

FIG. 2 is an antenna according to the present embodiment, which includes a first main antenna 11, a main section 121 of a second main antenna, an auxiliary section 122 of the second main antenna, a parasitic unit 2, and a connection component for keeping good electrical connection between the first main antenna 11 and the second main antenna 12. In the present embodiment, the connection component includes copper exposure areas 31 and 33 configured on the first main antenna 11, and metal elastic pieces 32 and 34 having good electrical connection with the copper exposure areas in a welding manner which is used for being electrically connected to the second main antenna 12 above the copper exposure areas. Wherein, the copper exposure area 31 is cooperatively used with metal elastic piece 32, and the copper exposure area 33 is cooperatively used with metal elastic piece 34. The whole structure of the antenna is configured in the headroom 6 on the PCB 5.

In the present embodiment, the second main antenna 12 is configured on the support, and includes two independent metal components, i.e., the main section 121 of the second main antenna and the auxiliary section 122 of the second main antenna, wherein, the main section 121 of the second main antenna 12 keeps good electrical connection with an antenna feed unit on the PCB through a feed part 4, and is designed to operate at a high band above 1 GHz, and the auxiliary section 122 of the second main antenna 12 is an independent metal piece structure, and is connected to the first main antenna 11.

In the present embodiment, the wiring of the first main antenna is primarily in a form of folded serpentine. The first main antenna 1 is configured in the headroom 6 of the PCBS, and is connected to the main section 121 of the second main antenna 12. There is a copper exposure area 31 at an upper left corner of the first main antenna 11. An end of metal elastic piece 32 keeps good electrical connection with the copper exposure area 31 in a welding manner, and the other end keeps good electrical connection with the main section 121 of the second main antenna 12 above the end. There is a copper exposure area 33 left at the upper right corner of the first main antenna 11. An end of the metal elastic piece 34 keeps good electrical connection with the copper exposure area 33 in a welding manner, and the other end keeps good electrical connection with the auxiliary section 122 of the second main antenna 12 above the end.

In the present embodiment, the parasitic unit 2 is configured on the support, is in the same plane as the main section 121 of the second main antenna 12 and the auxiliary section 122 of the second main antenna 12, and keeps good electrical connection with the ground of the PCB5 through the metal elastic pin. There is a gap 24 kept between the parasitic unit 2 and the second main antenna 12.

In the present embodiment, the electrical signal is fed into an antenna by the feed part 4. A part of the signal is fed in the main section 121 of the second main antenna 12, to enable it to operate at a high frequency part above 1 GHz; and the other part is fed in the first main antenna 11 via the connection component constituted by the copper exposure area 31 and metal elastic piece 32 to achieve good electrical connection between the main section 121 of the second main antenna 12 and the first main antenna 11.

Thereby, a low frequency radiation branch of the main antenna is commonly constituted by the first main antenna 11 and the auxiliary section 122 of the second main antenna 12, to complete requirements on radiation at a low band below 1 GHz. At the same time, the high frequency part of the main section 121 of the second main antenna 12 is further extended by the parasitic unit 2.

The second main antenna 12 in the present embodiment may be but is not limited to a form of wiring of the metal elastic piece on the support. Alternatively, the FPC wiring may be implemented on the support, or the wiring is directly designed on the back housing or rear housing through the metal elastic piece, FPC or using an LDS process without using the support. Alternatively, any other design forms which can achieve the above purpose may be used.

The connection component in the present embodiment, i.e., the copper exposure part 31 configured on the first main antenna 11 and metal elastic piece 32 configured on the main section 121 of the second main antenna 12 corresponding to the copper exposure part 31 may also use a metal pin or other collocation forms which can achieve the above purpose.

In the present embodiment, specific wiring forms and operating bands of the first main antenna 11, the main section 121 of the second main antenna 12 and the auxiliary section 122 of the second main antenna 12 may be adjusted according to performance requirements and debugging needs. As long as the forms embody a combination of a PCB antenna and a non-PCB antenna, the forms belong to the protection scope.

It may be decided whether the parasitic unit 2 and components of the auxiliary section 122 of the second main antenna 12 are added according to a change of application conditions and performance requirements.

The embodiments of the present invention further disclose a terminal device, comprising a terminal housing, a main board and an antenna, wherein the main board and the antenna are configured in the housing, the antenna comprises a first main antenna, a second main antenna and a connection component, the first main antenna is printed on the main board, and the second antenna is configured outside the main board and is electrically connected to the first main antenna through the connection component.

The second main antenna is configured on a support or a housing of a terminal device where the antenna is located.

The terminal device further comprises a parasitic unit, wherein, the parasitic unit is printed on the PCB, is located on the same side as the first main antenna, has a gap with the first main antenna, and is connected to the ground wire; or the parasitic unit is configured on the support or the housing of the terminal device where the antenna is located, is located on the same side as the second main antenna, has a gap with the second main antenna, and is connected to the ground wire.

The first main antenna comprises a feed part, which is connected to an antenna feed unit on the PCB, or the second main antenna comprises a feed part, which is connected to the antenna feed unit, the second main antenna comprises a main section of the second main antenna and an auxiliary section of the second main antenna which are independent from each other, the main section of the second main antenna comprises the feed part and is connected to the antenna feed unit and the first main antenna, and the auxiliary section of the second main antenna is connected to the first main antenna.

Of course, the present document can have a plurality of other embodiments. Without departing from the spirit and substance of the present document, those skilled in the art can make various corresponding changes and variations according to the present document, and all these corresponding changes and variations should belong to the protection scope of the appended claims in the present document.

INDUSTRIAL APPLICABILITY

In the above technical solution, by connecting the antenna printed on the PCB with the antenna configured outside the PCB, the limitation that wiring space is not enough in the antenna design is made up, and the utilization of the limited space can be significantly improved when the wiring of the antenna is designed. Therefore, the present document has a very strong industrial applicability.

What is claimed is:

1. An antenna, comprising: a Printed Circuit Board (PCB), a first main antenna, a second main antenna and a connection component, wherein the first main antenna is printed on the PCB, and the second main antenna is configured outside the PCB, and electrically connected to the first main antenna through the connection component;

wherein the second main antenna comprises a main section of the second main antenna and an auxiliary section of the second main antenna which are separated from each other, the main section of the second main antenna comprises the feed part and is connected to the antenna feed unit and the first main antenna, and the auxiliary section of the second main antenna is connected to the first main antenna.

2. The antenna according to claim 1, wherein, the second main antenna is configured on a support or a housing of a terminal device where the antenna is located.

3. The antenna according to claim 2, further comprising a parasitic unit, wherein, the parasitic unit is printed on the PCB, is located on the same side as the first main antenna, has a gap with the first main antenna, and is connected to a ground wire; or the parasitic unit is configured on the support or the housing of the terminal device where the antenna is located, is located on the same side as the second main antenna, has a gap with the second main antenna, and is connected to the ground wire.

4. The antenna according to claim 2, wherein, the first main antenna operates at a high frequency part, and the second main antenna operates at a low frequency part; or the first main antenna operates at the low frequency part and the second main antenna operates at the high frequency part.

5. The antenna according to claim 1, wherein, the first main antenna comprises a feed part which is connected to an antenna feed unit on the PCB, or the second main antenna comprises a feed part, which is connected to the antenna feed unit.

6. The antenna according to claim 1, wherein the connection component comprises a copper exposure area configured on the first main antenna, and a metal elastic piece integrated directly with the second main antenna, wherein the metal elastic piece is capable of being electrically connected to the copper exposure area.

7. A terminal device, comprising a terminal housing, a main board and an antenna, wherein the main board and the antenna are configured in the housing, the antenna comprises a first main antenna, a second main antenna and a connection component, the first main antenna is printed on the main board, and the second antenna is configured outside the main board and is electrically connected to the first main antenna through the connection component;

wherein the first main antenna comprises a feed part which is connected to an antenna feed unit on the PCB, or the second main antenna comprises a feed part which is connected to the antenna feed unit, the second main antenna comprises a main section of the second main antenna and an auxiliary section of the second main antenna which are separated from each other, the main section of the second main antenna comprises the feed part and is connected to the antenna feed unit and the first main antenna, and the auxiliary section of the second main antenna is connected to the first main antenna.

8. The terminal device according to claim 7, wherein, the second main antenna is configured on a support or the housing of the terminal device where the antenna is located.

9. The terminal device according to claim 8, further comprising a parasitic unit, wherein, the parasitic unit is printed on the PCB, is located on the same side as the first main antenna, has a gap with the first main antenna, and is connected to a ground wire; or the parasitic unit is configured on the support or the housing of the terminal device where the antenna is located, is located on the same side as the second main antenna, has a gap with the second main antenna, and is connected to the ground wire.

10. The terminal device according to claim 7, wherein the connection component comprises a copper exposure area configured on the first main antenna, and a metal elastic piece integrated directly with the second main antenna, wherein the metal elastic piece is capable of being electrically connected to the copper exposure area.

* * * * *